US005584551A

United States Patent [19]

Jenkins

[11] Patent Number: 5,584,551

[45] Date of Patent: Dec. 17, 1996

[54] REFRIGERATOR CABINET CONSTRUCTION

[75] Inventor: Thomas E. Jenkins, Louisville, Ky.

[73] Assignee: General Electric Company, Louisville, Ky.

[21] Appl. No.: 410,859

[22] Filed: Mar. 27, 1995

[51] Int. Cl.[6] ..... A47B 81/00; E06B 7/16

[52] U.S. Cl. ..... 312/401; 312/296; 312/21

[58] Field of Search ..... 312/214, 296, 312/236, 401, 405, 406, 406.2, 407, 407.1; 220/430, 431, 432, 433

[56] References Cited

U.S. PATENT DOCUMENTS

| | | | |
|---|---|---|---|
| 2,679,944 | 6/1954 | Morton | 220/9 |
| 2,843,286 | 7/1958 | Pulaski | 220/9 |
| 3,359,053 | 12/1967 | Hagendoorn | 312/405 X |
| 3,633,783 | 1/1972 | Aue | 220/9 G |
| 3,768,687 | 10/1973 | Spencer | 220/431 |
| 3,835,660 | 9/1974 | Franck | 312/406.2 X |
| 4,134,626 | 1/1979 | Kordes | 312/406.2 X |
| 4,134,627 | 1/1979 | Kuskowski | 312/214 |
| 4,469,383 | 9/1984 | Losert | 312/405 X |
| 4,653,819 | 3/1987 | Swerbinsky | 312/405 X |
| 4,714,304 | 12/1987 | Sisk et al. | 312/406.2 |
| 4,732,432 | 3/1988 | Keil et al. | 312/214 |
| 4,884,415 | 12/1989 | Mandel et al. | 312/405 X |
| 5,349,832 | 9/1994 | Johnson et al. | 312/407 X |
| 5,476,318 | 12/1995 | Yingst et al. | 312/405 |

*Primary Examiner*—Peter M. Cuomo
*Assistant Examiner*—Robert J. Sandy
*Attorney, Agent, or Firm*—H. Neil Houser

[57] ABSTRACT

A refrigerator cabinet includes a metal outer case with top and side walls. A narrow front face projects inward from the walls and a stiffening flange, positioned rearward of the face, projects inward of the walls substantially further than the face. A pair of open front liners are received within and spaced from the outer case and from each other. The liners have top and side walls with distal edges located rearward of the stiffening flange. An elongated plastic breaker strip extends between the outer case front face and the liner top and outer side walls. The breaker strip front wall overlaps the outer case front face and extends inward to a position inward of the inner edge of the stiffening flange. The breaker strip side wall extends rearward from the breaker strip front wall to a position overlapping the top and outer side walls of the liners. An elongated plastic mullion has a front wall positioned in the plane of the breaker strip front wall and extending from one liner inner side wall to the other liner inner side wall. The mullion also has side walls which extend rearwardly from its front wall and overlap the liner inner side walls. A pair of doors cover the front of the liners when closed and include flanges which register with the breaker strip front wall and portion of the mullion front wall surrounding the corresponding liner. A gasket is mounted on each door flange and essentially completely covers the corresponding front walls.

47 Claims, 4 Drawing Sheets

REFRIGERATOR CABINET CONSTRUCTION

BACKGROUND OF THE INVENTION

For many years it has been a general practice to hold the doors of refrigerators closed by cooperating strips of magnetic material. To that end a section of steel at the front of the refrigerator outer case was folded to form a wide, multiple thickness front face. A breaker strip was mounted to the front of the case and to the inner liner and the front face and breaker strip formed the front of the cabinet. Typically elongated strips of magnet material were positioned within the gasket mounted on the door. When the door was closed, the steel front face of the case and the magnet material attracted each other to hold the door closed and compress the gasket for an air seal.

As designs advanced it became feasible to make the outer case of thinner metal. In order to provide structural strength and the degree of rigidity needed at the front of the cabinet, the sheet metal was bent to form an inwardly projecting stiffening flange positioned to the rear of the cabinet front face.

The space between the outer case and the liner normally was filled with a foamed-in-place insulation, such as polyurethane for example. Despite the excellent insulating characteristics of such foam, the door seal area at the front of the cabinet has been a source of relatively high heat leakage between the storage compartments in the refrigerator and the ambient atmosphere surrounding the refrigerator.

More recently a greater need to increase the efficiency of all refrigeration apparatus has developed; which has led to the need to reduce the thermal transfer through the door seal area and the front of the cabinet. At the same time the need remains to minimize the thickness of the outer case material while maintaining the strength of the cabinet.

Therefore it is an object of this invention to provide an improved refrigerator cabinet construction.

It is another object of the present invention to provide an improved cabinet construction which minimizes heat transfer through the door seal area.

SUMMARY OF THE INVENTION

A refrigeration appliance comprises a metal outer case including a lateral wall with an inwardly turned front face joined to a stiffening flange positioned rearward of the front face and extending inward of the lateral wall substantially further than the front face. A liner nested within the case includes a lateral wall spaced inward of the case lateral wall. The liner lateral wall has a distal edge positioned substantially rearward of the outer case front face. A breaker strip of a suitable resilient insulation material extends between the outer case and liner lateral walls. The breaker strip includes a front wall extending inward from the outer case lateral wall to a position inward of the liner lateral wall and a side wall extending rearward from the breaker strip front wall to the liner lateral wall. A door, having a closed position covering the front of the liner, includes a peripheral flange positioned in register with the breaker strip front wall when the door is in its closed position. A gasket mounted on the door engages and essentially completely covers the breaker strip front wall when the door is closed.

DETAILED DESCRIPTION OF PREFERRED EMBODIMENT

Figure 1:
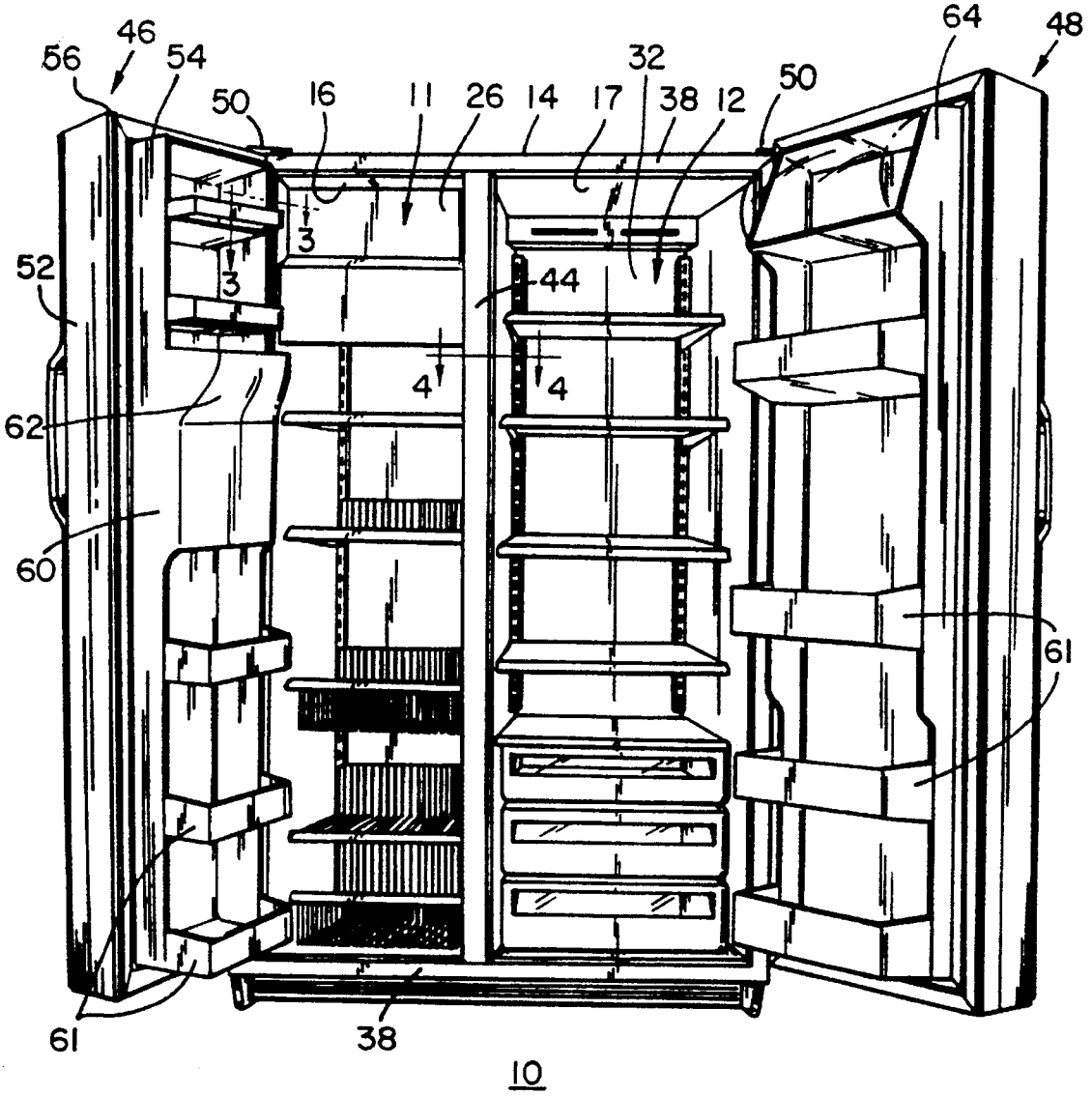
FIG. 1 is a perspective view of a side-by-side refrigerator with the access doors open for purposes of illustration.

FIG. 1 illustrates a refrigeration appliance 10 of the side-by-side refrigerator type; that is a freezer storage compartment 11 and a fresh food storage compartment 12 are arranged side-by-side within the refrigerator. The refrigerator 10 has a cabinet including an outer case 14 and inner liners 16, 17, which form the freezer compartment 11 and the fresh food compartment 12 respectively. The liners 16, 17 are spaced from the case 14 and from each other and the space between these elements is filled with insulation 18 (see FIGS. 3 and 4), such as a foamed in place polyurethane.

Figure 2:
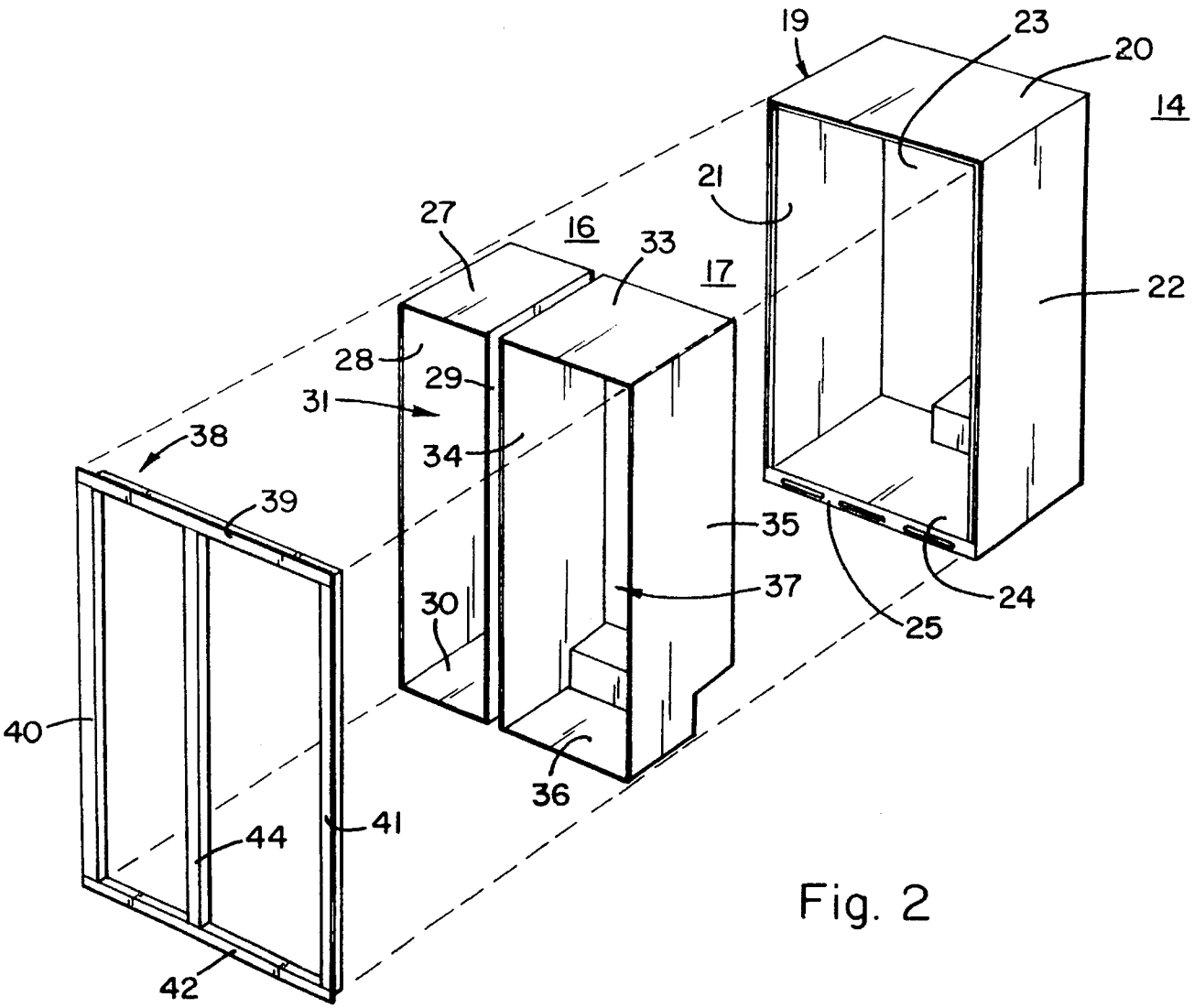
FIG. 2 is a a simplified, exploded perspective view of the outer case, liners and breaker strip and mullion assembly of the refrigerator of FIG. 1.

Referring to FIG. 2, the outer case 14 conveniently is principally formed from a sheet 19 of a suitable metal, such as a pre-painted steel. The sheet is bent into an inverted U-shape forming the lateral walls of the case; that is the top 20, left side 21 and right side 22. The back 23 generally is added after various connections are made to the operating components of the refrigerator and normally is made from a much lighter material. A heavy metal frame including a front brace 25, is provide at the bottom of the refrigerator to support the cabinet and all the various operation components. As the bottom wall 24 can be thinner than the metal sheet 19, it generally is formed separately and then is attached to the sides 21, 22 and to the metal frame, including the front brace 25. However, if desired, the bottom can be formed from the same sheet as the top and sides.

It will be understood that, as used herein, "rearward", and other terms of like import, refer to the direction toward the back wall 23 from the front of the case; "forward", and other terms of similar import, refer to the direction from the back wall 23 toward the front of the case; "inward", and other terms of similar import, refer to the directions from the top 20, side 21, 22 and bottom 23 walls toward the inside of the cabinet; and "outward", and other terms of like import, refer to the directions from the interior of the cabinet toward any of walls 20–24.

The freezer liner 16 has an open front box-like configuration with a rear wall 26 (see FIG. 1) bounded by integral top 27, side 28, 29 and bottom 30 walls. The front of the lateral walls 27–30 define the open front 31 of freezer storage compartment 11. The fresh food liner is a similarly constructed open front box-like configuration with a rear wall 32 bounded by integral top 33, side 34,35 and bottom 36 walls. The lateral walls 33–36 define the open front 37 of fresh food storage compartment 12. The lateral walls 27–30 and 33–36 of the liners are narrower than the lateral walls 20–23 of the outer case 14. As will be discussed in more detail later, when the liners 16–17 are nested in the case 14, the front distal edges of the liners are a substantial distance rearward of the front of the case. Currently most side-by-side refrigerators, like the exemplification embodiment, are large capacity units and it is preferred to form the liners 11,12 from sheet metal. However, other types of refrigerators, particularly smaller capacity units have liners molded from suitable plastic materials.

A breaker strip 38; comprising top 39, side 40,41 and bottom 42 sections; spans the gap between the case 14 and the outer walls 27, 28, 30 and 33, 35, 36 of the liners 16, 17. A mullion 44 spans the gap between the inner walls 29, 34 of the liners. The breaker strip and mullion normally are molded of a resilient insulation material, such as a suitable plastic material. By way of example, the breaker strip and mullion of the exemplification embodiment of FIGS. 1–4 are molded of an acrylo-butadiene-styrene (commonly referred to as ABS), a styrenic material or an olefin material The breaker strip and mullion will be described in greater detail hereafter. As will be described in more detail hereafter, when the liner(s) are made of a suitable plastic material, the breaker strip and mullion can be molded integrally with the liner(s).

Referring again to FIG. 1, a freezer door 46 and a fresh food door 48 close the front access openings 31,37 of the freezer and fresh food compartments 11,12 respectively. Each is mounted by top hinges 50 and bottom hinges, not shown, to rotate about its outer edge between an open position, generally as shown in FIG. 1, and a closed position in register with the breaker strip and mullion to close the openings 31,37. Conveniently both doors have the same basic construction and it will be understood that the following description of freezer door 46 also applies to fresh food door 48. Door 46 includes an outer panel 52, normally formed by a folded sheet of metal, and an inner panel 54, normally molded of a suitable plastic material. The junction of the inner and outer panels forms a flange 56 which extends around the periphery of the door facing the case 14 and a gasket 58 is mounted on the flange 56. When the door is in its closed position, the gasket 56 engages the portion of breaker strip 38 and mullion 44 around the freezer liner 16. Additional details of a flange and gasket construction suitable for use with the present invention may be had by reference to U.S. Pat. No. 5,487,239 of Thomas Jenkins et al, entitled Improved Refrigerator Gasket Assembly, and assigned to General Electric Company, the assignee of the present invention; which patent is hereby incorporated herein by reference.

Within the flange 56, the inner panel 54 is formed with a wall 60 that projects away from outer door panel 52 and is received within the freezer liner 16 when the door is closed. The wall 60 supports removable shelves 61 for items to be stored. In addition, the inner panel can be formed with integral features such as an ice dispenser 62 (door 46) or a butter and cheese keeper 64 (door 48). Conveniently the space between the inner and outer door panels also is filled with suitable insulation 18 (see FIG. 3).

Figure 3:
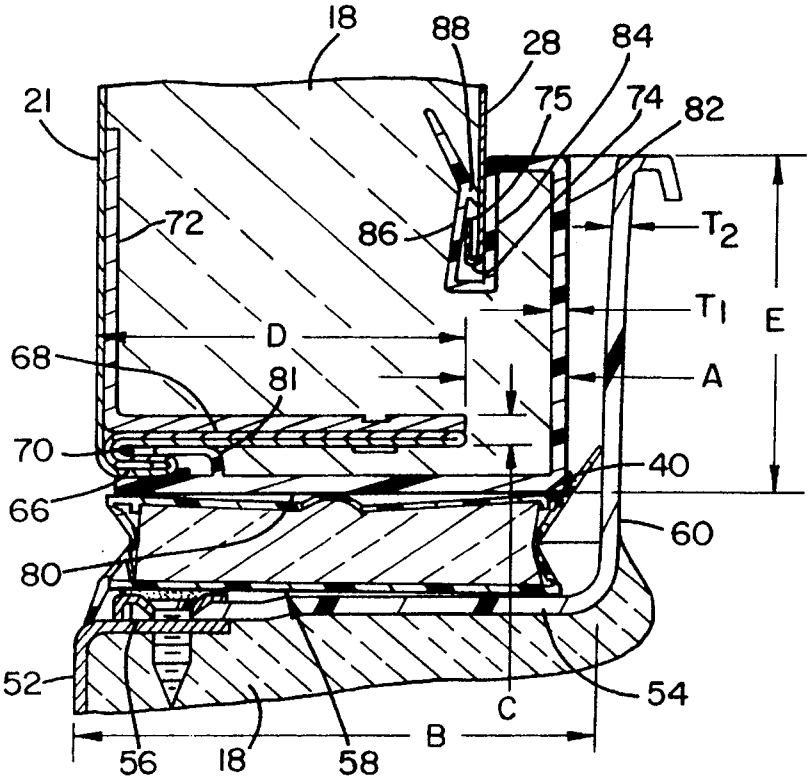
FIG. 3 is a cross-section view of the left hand side portion of the refrigerator case as seen at line 3—3 in FIG. 1 but with door closed.

Viewing particularly FIG. 3, the front portion of the sheet 19 forming side wall 21 of outer case 14 is bent to provide a double thickness of metal. This double thickness portion is then bent to provide a front face 66 which runs along substantially the entire length of side wall 21 and projects generally perpendicularly inward a short distance. The double thickness portion is further bent to form a stiffening flange 68 which also extends along substantially the entire length of side wall 21 and is spaced to the rearward of face 66 to form a recess or groove 70. The stiffening flange 68 projects inwardly a substantially greater distance than face 66. It will be understood that the front section of the top wall 20 and other side wall 22 are formed in a like manner.

If desired an elongated reinforcing member 72 is mounted against the inside of side wall 21 and stiffening flange 68 by suitable means such as, for example, welding. A like reinforcing member is mounted against the stiffening flange of side wall 22. The reinforcing members adds additional stiffness and strength to the front of the outer case. This permits the use of an even thinner metal sheet to make the case while assuring that the openings to the storage compartments will remain square and that the doors 46,48 will hang properly and completely seal the compartments when they are closed. It will be understood that, if a stronger material is used for the outer case 14, then the reinforcing member may be omitted.

The front distal edge 74 of the adjacent side wall 28 of freezer liner 16 terminates well rearward of the face 66 and somewhat to the rear of stiffening flange 68. The edge is bent over to form an outward disposed hook 75 which extends along substantially the entire length of wall 28.

The side section 40 of breaker strip 38 bridges the gap between outer case wall 21 and liner wall 28. Breaker strip section 40 includes a front wall 80 that overlaps the front face 66 of the outer case and extends inward to a position inside the liner side wall 28. A flexible finger 81 is formed adjacent the distal edge of the front wall 80 and is received in the recess or groove 70 so that the outer case front face 66 is held between breaker strip front wall 80 and finger 81. The inner edge of front wall 80 joins the outer edge of a breaker strip side wall 82 that projects rearwardly to overlap the forward portion of liner side wall 28. The side wall 82 is spaced inward of the side wall 28 and the rear end of side wall 82 is formed with a reverse bend providing a short inner wall 84 which lies against liner side wall 28. The forward end of wall 84 is formed with another reverse bend and a flexible finger 86 extends rearwardly along the outside of liner wall 28. The finger 86 is angled toward inner wall 84 to secure the breaker strip section 40 to the liner wall 28. In addition the finger 86 is formed with a hook 88 that cooperates with hook 75 on wall 28 to assure that the breaker strip is not forced off the wall by the pressure generated when the insulation 18 is foamed in place. The foamed insulation completely fills the space between the case side wall 21 and liner side wall 28 to the rear of the breaker strip section 40, including the space between strip side wall 82 and inner wall 84 and between stiffening flange 68 and breaker strip front wall 80.

It will be understood that the top section 39 and the other side section 41 of breaker strip 38 are formed with essentially the same configuration and are connected between the corresponding walls of the case 14 and liners 16,17 with essentially the same relationship as described above for section 40. The bottom section 42 is similar to section 40, differing only slightly to interfit with the simple top edge of the front brace 25. Thus, it will be understood that the foregoing description also applies to the other sections of the breaker strip. Also it will be understood that, for ease of assembly, the breaker strip is formed from four separate sections which are joined together to bridge between the outer case and the liners. Thus the breaker strip can be considered as a single element. Additional details of the construction of the breaker strip 38 and its assembly to the case and liners may be had by reference to co-pending application Ser. No. 08/410,860, filed 03/27/95, of Thomas Jenkins et al, entitled "Improved Breaker Strip Assembly and Method", and assigned to General Electric Company, assignee of the present invention; which co-pending application is hereby incorporated herein by reference.

Figure 4:
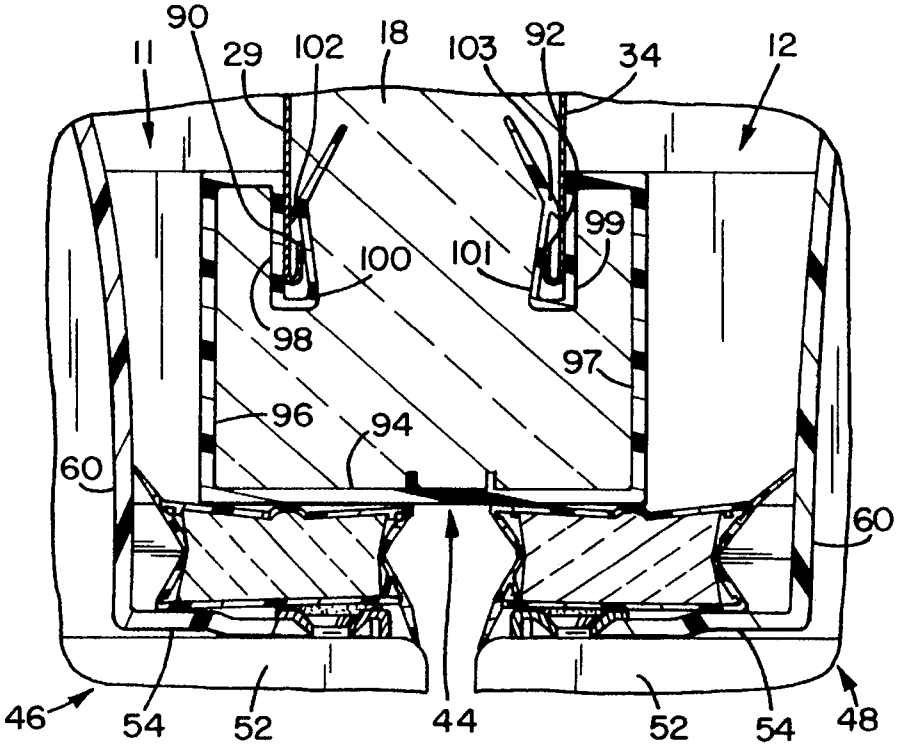
FIG. 4 is a cross-section view of the mullion area of the refrigerator as seen along line 4—4 in FIG. 1.

Referring now to FIG. 4, there is illustrated certain details of the mullion 44 and its assembly to liners 16 and 17. The distal front edges of inner side walls 29,34 of liners 16,17 are bent over into hooks 90,92 respectively. The mullion 44 includes a front wall 94 which spans the gap between and extends slightly outward beyond the walls 29,34. Side walls 96,97 extend rearward from the lateral edges of the front wall 94 and overlap the liner side walls 29, 34 respectively. The rear edges of the side walls 96,97 are return bent to form inner walls 98, 99 which bear against liner side walls 29, 34 respectively. the front edges of inner walls 98,99 are return bent to form flexible fingers 100, 101 which bear against the other side of liner walls 29,34 . Thus the liner side walls 29,34 and the mullion 44 are secured together. The flexible fingers include hooks 102,103 which overlap liner wall hooks 90,92 and assure that the pressure resulting from the insulation foaming operation does not cause the mullion and liners to separate.

Leakage of thermal energy through the area of the door seal constitutes a substantial portion of the heat loss of a typical refrigerator. This loss occurs through the components making up the front of the cabinet, the door and the gasket, rather than as a result of air leaking between the cabinet front face and the gasket. Also, the front brace 25 normally is sufficiently large that it will provide enough strength and rigidity even though it is a significant distance from the front bottom edge of the liners. This provides ample room for sufficient insulation. Therefore, the thermal loss principally is a concern with the sides and top of the refrigerator. I have found that careful selection of the size and relationship of certain components will provided a significant improvement in the energy efficiency of a refrigerator.

Referring now to FIG. 3, certain dimensions have been labeled for ease of reference and understanding, generally as follows:

"A" is the distance between the inner end of the stiffening flange 68 and the side wall 82 of the breaker strip 38.

"B" is the length of the gasket 58.

"C" is the thickness of the stiffening flange, or the stiffening flange and reinforcing member together when a reinforcing member is used.

"D" is the length of the stiffening flange, that is the distance which it projects inward from the outside wall of the case.

"E" is the length of the breaker strip side wall 82.

"T1" is the thickness of the breaker strip and, more particularly, of the side wall 82.

"T2" is the thickness of the inner door panel wall 60.

D controls the stiffness of the front of the cabinet as the cabinet stiffness generally varies with the cube of D. A and C control the flow of heat flux through the structural steel of the outer case 14. Thus it is desirable to make C as small as possible and A as large as possible. However, this conflicts with the desirability of making D as large as possible since enlarging both A and D will decrease the width of the storage compartment(s) in an outer case of a given width. Dimension B controls the amount of heat flux which can be lost through T1 and T2. Thus it is desirable to make B as long as possible, which conflicts with the need to make the openings to the storage compartments as large as possible. It will be recognized that the maximum length of B is directly related to the combined length of A and D.

I have found that an optimum balance of the dimensions provides significant energy loss savings without unduly impacting the size of the storage compartment(s) relative to the outer case. In the exemplification embodiment dimension A is between 0.2 inch and 0.4 inch adjacent liner 17, which serves as a fresh food storage compartment, and between 0.5 inch and 0.8 inch adjacent liner 16, which serves as the freezer storage compartment; dimension D is between 1.0 inch and 1.4 inch; dimension C is between 0.06 inch and 0.2 inch; and dimension E is at least 1.0 inch.

Referring again to FIG. 4, in the exemplification embodiment the width of the mullion is between 1.5 inches and 2.1 inches and the width (or depth) of the mullion side walls is at least 1.0 inch.

The overlapping offset or spacing of the breaker strip and mullion side walls inside the lateral walls of the liners permits the dimensions A and D to be maximized while maintaining a maximum size of the freezer and fresh food compartments. If desired the small ledge formed by such an offset can be eliminated by reducing the size of the storage compartments.

Figure 6:
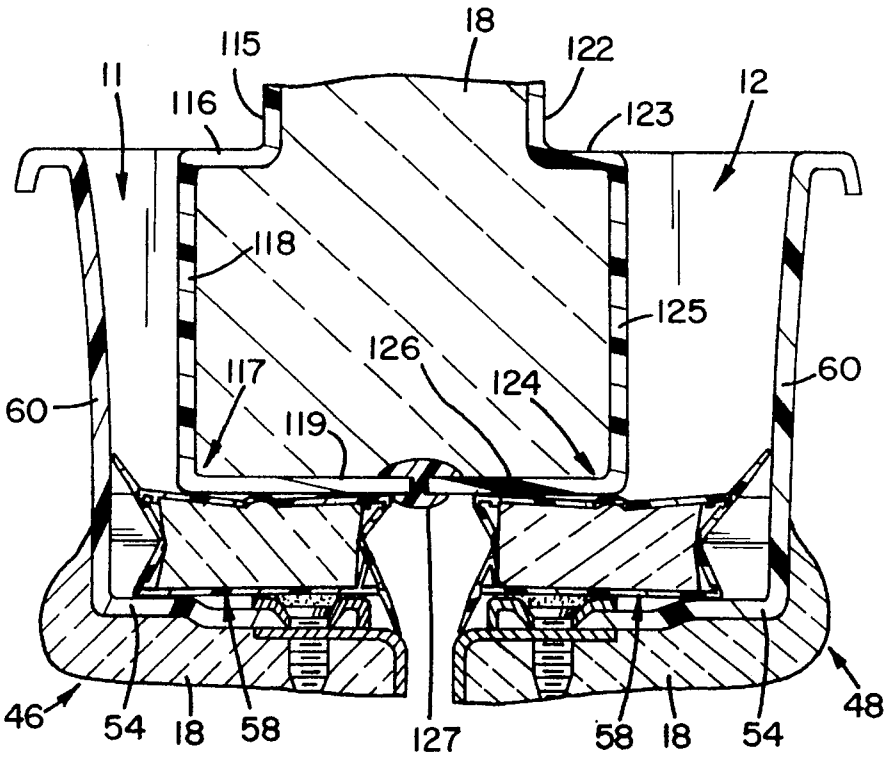
FIG. 6 is a cross-section view similar to FIG. 4, but illustrating additional features of the embodiment of FIG. 5.
Figure 5:
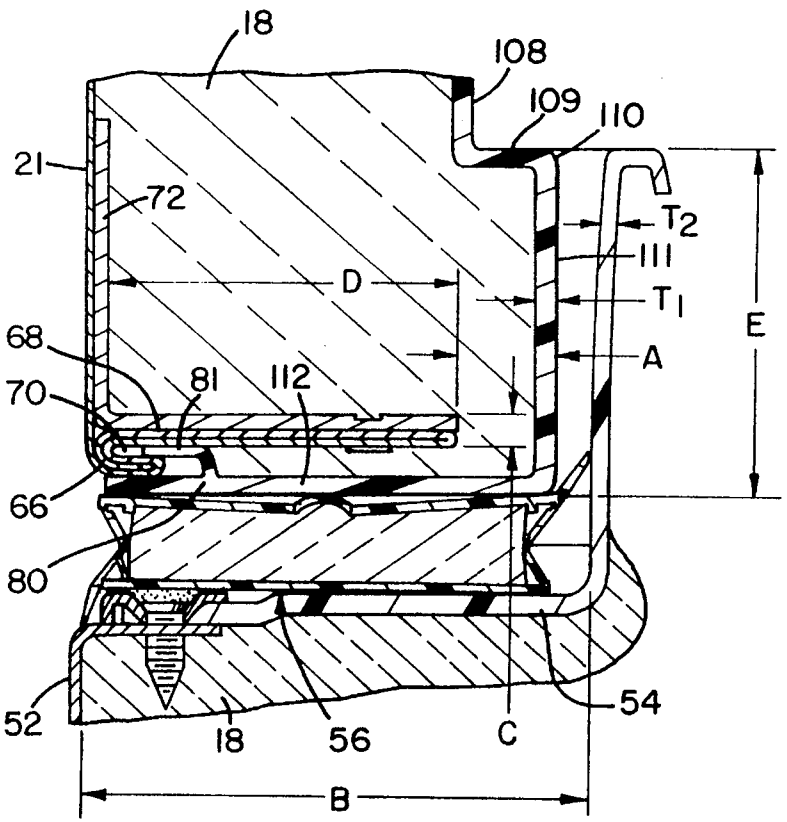
FIG. 5 is a cross-section view similar to FIG. 3, but illustrating a refrigerator incorporating another embodiment of the invention.

Referring to FIGS. 5 and 6, there is illustrated another exemplification embodiment of the present invention in which the inner liners are formed of a suitable resilient material such as an appropriate plastic, and the breaker strip and mullion are formed integrally with the inner liners. The outer case and doors conveniently may be of the same construction as in FIGS. 1–4 and like numerals have been used to identify like components. The freezer compartment 11 is formed by a liner of suitable resilient insulation material and is of an open front, box like configuration generally like liner 16, except that the breaker strip and mullion section are formed integrally with the side and top walls of the liner. Referring to FIG. 5, the front distal edge of liner outer side wall 108 is offset inward at 109 and joins an integral breaker strip 110. The breaker strip side wall 111 extends forward from the offset 109 to the plane or level of case front face 66. Breaker strip front wall 112 extends outward from side wall 111 and overlaps the outer case front face 66. It will be understood that the side wall 111 and front wall 112 extend continuously along the outer side wall 108 and top walls of the freezer liner. The portion of the breaker strip along the top of the freezer liner has not been shown or described for the sake of brevity. Referring now to FIG. 6, the freezer liner has an inner side wall 115. The distal front edge of wall 115 is off set outward at 116 and joins an integral mullion strip or portion 117. The mullion strip 117 includes a side wall 118 which extends forward from the offset 116 to the level or plane of the outer case front face 66. A mullion strip front wall 119 projects toward the fresh food liner. The mullion strip 117 extends along the inner side wall 115 and joins the top portion of the breaker strip 110 so that the breaker strip and mullion strip extend completely along the side and top walls of the freezer liner.

The fresh food liner includes an integral breaker strip along its outer side and top walls, which conveniently can be the same configuration and construction as breaker strip 110. Therefore, the fresh food liner breaker strip has not been shown or described for the sake of simplicity. Referring to FIG. 6, the fresh food liner includes an inner side wall 122. The distal front edge of the wall 122 is off set at 123 and joins an integral mullion strip or portion 124. The mullion strip 124 includes a side wall 125 that extends forward from offset 123 to the level or plane of outer case front face 66. The mullion strip 124 also includes a front wall 126 that extends toward mullion 117. The mullion strip 124 extends along the inner side wall of the fresh food liner and joins the top portion of the fresh food liner breaker strip to form an uninterrupted structure along the sides and top of the liner.

The mullion front walls 119,126 lie substantially in the plane of the outer case front face 66 and the breaker strip front wall and come into substantial abutting relationship. A joining member 127 connects the distal edges of the front walls 119,126. Conveniently the joining member can be an extrusion of a suitable resilient insulation material. The mullion strips or portions 119, 126, together with the joining member 127, form an essentially unitary mullion with an unbroken front wall. If desired, the distal edges of the front walls 119,126 can be configured to interfit and the member 127 omitted. However, the use of a member 127 has the advantage of compensating for manufacturing tolerances.

Preferably the dimensions A, B, C, D, T1 and T2 will be the same for the embodiment of FIGS. 5–6 as previously described for the embodiment of FIGS. 1–4.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A refrigeration apparatus comprising:

a metal outer case including a lateral wall with an inwardly turned front face joined to a stiffening flange spaced rearward of said front face and extending inward of said lateral wall substantially further than said front face;

a liner nesting within and spaced from said outer case and including a rear wall joined to a lateral wall forming a storage compartment said lateral wall being spaced inward of said outer case lateral wall, said liner lateral wall including a distal edge positioned substantially rearward of said outer case front face;

a resilient insulation breaker strip extending between said outer case lateral wall and said liner lateral wall; said breaker strip including a front wall extending inward from said outer case lateral wall to a position inward off said liner lateral wall; said breaker strip also including a side wall extending rearward to said liner lateral wall;

a door having a closed position covering the front of said liner, said door including a peripheral flange positioned in register with said breaker strip front wall when said door is in its closed position; and a gasket mounted on said door flange and constructed to engage and essentially completely cover said breaker strip front wall when said door is in its closed position.

2. A refrigeration apparatus as set forth in claim 1, wherein: the distance between the inner edge of said stiffening flange and said side wall of said breaker strip is between about 0.2 inch and about 0.8 inch.

3. A refrigeration apparatus as set forth in claim 1, wherein: said liner defines a fresh food storage compartment and the distance between the inner edge of said stiffening flange and said side wall of said breaker strip is between about 0.2 inch and about 0.4 inch.

4. A refrigeration apparatus as set forth in claim 1, wherein: said liner defines a freezer storage compartment and the distance between the inner edge of said stiffening flange and said side wall of said breaker strip is between about 0.5 inch and about 0.8 inch.

5. A refrigeration apparatus as set forth in claim 1, wherein said stiffening flange extends inward of said outer case lateral wall a distance between about 1 inch and about 1.4 inches.

6. A refrigeration apparatus as set forth in claim 5, wherein: the distance between the inner edge of said stiffening flange and said side wall of said breaker strip is between about 0.2 inch and about 0.8 inch.

7. A refrigeration apparatus as set forth in claim 5, wherein: said liner defines a fresh food storage compartment and the distance between the inner edge of said stiffening flange and said side wall of said breaker strip is between about 0.2 inch and about 0.4 inch.

8. A refrigeration apparatus as set forth in claim 5, wherein: said liner defines a freezer storage compartment and the distance between the inner edge of said stiffening flange and said side wall of said breaker strip is between about 0.5 inch and about 0.8 inch.

9. A refrigeration apparatus as set forth in claim 1, wherein: said stiffening flange has a thickness between about 0.06 inch and about 0.2 inch.

10. A refrigeration apparatus as set forth in claim 1, wherein:

an L-shaped reinforcing member is connected to said outer case lateral wall and said stiffening flange; and wherein said stiffening flange and reinforcing member have a combined thickness between about 0.06 inch and about 0.2 inch.

11. A refrigeration apparatus as set forth in claim 1 wherein: said breaker strip side wall extends rearward from said breaker strip front wall for a distance of at least about 1.0 inch.

12. A refrigeration apparatus as set forth in claim 1, wherein: the inner edge of said stiffening flange is substantially aligned with the distal edge of said liner lateral wall and said breaker strip side wall is positioned inside said liner lateral wall between about 0.2 inch and about 0.8 inch.

13. A refrigerator cabinet comprising:

a metal outer case including spaced apart side walls connected by a top wall; a narrow, inwardly projecting front face extending along said case top and side walls; and a stiffening flange extending along said case top and side walls and spaced rearward of said front face; said stiffening flange having a width of about 1.0 inch and about 1.4 inches and projecting inward substantially further than said front face;

an open front metal liner nestled within and spaced from said outer case; said liner having a rear wall joined to spaced apart side walls and a top wall; each of said liner side and top walls having a distal front edge positioned rearward of said outer case stiffening flange;

a resilient insulation strip extending between each of said outer case top and side walls and the corresponding top and side walls of said liner; said breaker strip including a front wall extending inward from said outer case top and side walls to a position inward of the inner edge of the corresponding outer case stiffening flange; said breaker strip also including a side wall extending rearward from said breaker strip front wall to a position overlapping and spaced inward of said corresponding liner top and side walls; and said corresponding stiffening flange and breaker strip side wall are spaced apart between about 0.2 inch and 0.8 inch.

14. A refrigerator cabinet as set forth in claim 13, wherein: said liner defines a fresh food storage compartment and said corresponding stiffening flange and breaker strip side wall are spaced apart between about 0.2 inch and about 0.4 inch.

15. A refrigerator cabinet as set forth in claim 13, wherein: said liner defines a freezer storage compartment and said corresponding stiffening flange and breaker strip side wall are spaced apart between about 0.5 inch and about 0.8 inch.

16. A refrigerator cabinet as set forth in claim 13, wherein: said corresponding stiffening flange has a thickness between about 0.06 inch and about 0.2 inch.

17. A refrigerator cabinet as set forth in claim 13, wherein:

an L-shaped reinforcing member is connected to each of said case outer case side walls and the corresponding portions of said stiffening flange; and each reinforcing member and said corresponding portion of said stiffening flange have a combined thickness between about 0.06 inch and about 0.32 inch.

18. A refrigerator cabinet as set forth in claim 13, further including:

a door having a closed position covering the front of said liner, said door including a peripheral flange positioned to be in with register with said breaker strip front walls when said door is in its closed position; and a gasket mounted of said door peripheral flange and constructed to engage and cover essentially the entire front surface of said breaker strip front walls.

19. A refrigerator cabinet as set forth in claim 18, wherein: said breaker strip front wall overlaps said corresponding outer case front face so that a portion of said breaker strip front wall is between said gasket and said corresponding outer case front face when said door is in its closed position.

20. A refrigerator cabinet comprising:

a metal outer case including spaced apart side walls connected by a top wall; a narrow, inwardly projecting front face extending along said case top and side walls; and a stiffening flange extending along said case top and side walls spaced rearward of said face; said stiffening flange having a width between about 1.0 inch and about 1.4 inches and projecting inward substantially further than said front face;

a pair of open front liners received in said case in spaced apart relationship to each other and to said outer case; each liner having a rear wall joined to spaced apart side walls and a connecting top wall; said liner top and side walls having a distal front edge positioned rearward of said outer case stiffening flange;

a resilient insulation breaker strip extending between each of said outer case top and side walls and the corresponding liner top and side walls; each breaker strip including a front wall overlapping said outer case front face and extending inward to a position inward of said outer case stiffening flange; each breaker strip also including a side wall extending rearward from its front wall to a position overlapping and spaced inward of said corresponding liner top and side walls;

said corresponding stiffening flanges and breaker strip side walls being spaced apart between about 0.2 inch and about 0.8 inch;

an elongated mullion of resilient insulation material including a front wall lying in the plane of said breaker strip front walls and overlying said front edge of each of said liner inner side walls; said mullion also including spaced apart side walls extending rearward to positions overlapping and spaced inward of said liner inner side walls;

so that the front of said cabinet consists of said breaker strip and mullion front walls.

21. A refrigerator cabinet as set forth in claim 20, wherein: one of said liners defines a fresh food storage compartment and the distance between the inner edge of said outer case stiffening flange adjacent said top and outer side walls of said one liner and the corresponding side walls of said breaker strip is between about 0.2 inch and about 0.4 inch.

22. A refrigerator cabinet as set forth in claim 20, wherein: one of said liners defines a freezer storage compartment and the distance between the inner edge of said outer case stiffening flange adjacent said top and outer side walls of said one liner and the corresponding side walls of said breaker strip is between about 0.5 inch and about 0.8 inch.

23. A refrigerator cabinet as set forth in claim 20, wherein: said stiffening flange extends inward from said outer case top and side walls a distance between about 1 inch and 1.4 inches.

24. A refrigerator cabinet as set forth in claim 20, wherein said stiffening flange has a thickness between about 0.06 inch and about 0.2 inch.

25. A refrigerator as set forth in claim 24, wherein:

a L-shaped reinforcing member is connected to said outer case side walls and corresponding portions of said stiffening flange; and each reinforcing member and the corresponding portion of said stiffening flange have a combined thickness between about 0.06 inch and about 0.2 inch.

26. A refrigerator cabinet as set forth in claim 20, wherein said breaker strip side wall extends rearward from said breaker strip front wall a distance of at least about 1.0 inch.

27. A refrigerator cabinet as set forth in claim 20, wherein: said mullion front wall is between about 1.5 and about 2.0 inches wide.

28. A refrigerator as set forth in claim 27, wherein: said mullion side walls extend rearward from said mullion front wall a distance of at least about 1.0 inch.

29. A refrigerator cabinet as set forth in claim 20, further including:

a pair of doors having closed positions covering the front of corresponding liners; each of said doors including a peripheral flange positioned to be in register with said breaker strip front wall and the portion of said mullion front wall surrounding said corresponding liner when that door is in its closed position; and a gasket mounted to each of said door flanges and constructed to engage and essentially completely cover the corresponding front walls.

30. A refrigerator cabinet comprising:

a metal outer case including spaced apart side walls connected by a top wall; a narrow, inwardly projecting front face extending along said case top and side walls; and a stiffening flange extending along said case top and side walls spaced rearward of said front face and projecting inward of said case top and side walls substantially further than said front face;

an open front inner liner of resilient insulation material nestled within and spaced from said outer case; said liner having a rear wall integral with spaced apart side walls and a top wall forming a storage compartment; each of said liner side and top walls having a distal front edge positioned rearward of said outer case stiffening flange;

a resilient insulation breaker strip extending between each of said outer case top and side walls and the corresponding top and side walls of said liner; said breaker strip including a front wall extending inward from said one of said outer case top and side walls to a position inward of the inner edge of the corresponding outer case stiffening flange; said breaker strip also including a side wall extending rearward from said breaker strip front wall to a position substantially aligned with and spaced inward of the corresponding one of said liner top and side walls; said breaker strip side wall having a rear distal edge joined to said front distal edge of said corresponding one of said liner side and top walls; and said corresponding stiffening flange and said breaker strip side wall are spaced apart between about 0.2 inch and about 0.8 inch.

31. A refrigerator cabinet as set forth in claim 30, wherein: said breaker strip side wall is offset inward of said liner top and side walls.

32. A refrigerator cabinet as set forth in claim 30, wherein: said liner defines a fresh food storage compartment and said stiffening flange and breaker strip side wall are spaced apart between about 0.2 inch and about 0.4 inch.

33. A refrigerator cabinet as set forth in claim 30, wherein: said liner defines a freezer storage compartment and said stiffening flange and breaker strip side wall are spaced apart between about 0.5 inch and about 0.8 inch.

34. A refrigerator cabinet as set forth in claim 30, wherein: said stiffening flange has a thickness between about 0.06 inch and about 0.2 inch.

35. A refrigerator cabinet as set forth in claim 30, wherein:

an L-shaped reinforcing member is connected to each of said outer case side walls and corresponding portions of said outer case stiffening flange; and each reinforcing member and corresponding portion of said stiffening flange have a combined thickness between about 0.06 inch and about 0.32 inch.

36. A refrigerator cabinet as set forth in claim 30, further including:

a door having a closed position covering the front of said liner, said door including a peripheral flange positioned to be in with register with said breaker strip front walls when said door is in its closed position; and a gasket mounted of said door peripheral flange and constructed to engage and cover essentially the entire front surface of said breaker strip front walls.

37. A refrigerator cabinet as set forth in claim 36, wherein: said breaker strip front wall overlaps said corresponding outer case front face so that a portion of said breaker strip front wall is between said gasket and said corresponding outer case front face when said door is in its closed position.

38. A refrigerator cabinet comprising:

a metal outer case including spaced apart side walls connected by a top wall; a narrow, inwardly projecting front face extending along said case top and side walls; and a stiffening flange extending along said case top and side walls and spaced rearward of said face; said stiffening flange having a width between about 1.0 inch and about 1.4 inches and projecting inward substantially further than said front face;

a pair of open front liners of resilient material insulation material received in said case in spaced apart relationship to each other and to said outer case; each liner having a rear wall joined to spaced apart inner and outer side walls and a connecting top wall; each of said liner top and side walls having a distal front edge positioned rearward of said outer case stiffening flange;

a breaker strip of resilient insulation material extending between said liner top and outer side walls and corresponding case top and side walls; said breaker strip including a front wall overlapping said outer case front face and extending inward to a position inward of said outer case stiffening flange; said breaker strip also including a side wall extending rearward from its front wall to a position substantially aligned with and spaced inward of said corresponding liner top and outer side walls; each of said breaker strip side walls having a distal rear edge joined to said distal front edge of said corresponding liner top and outer side walls;

said corresponding stiffening flanges and breaker strip side walls being spaced apart between about 0.2 inch and about 0.8 inch;

an elongated mullion of resilient insulation material; said mullion including side walls overlapping and spaced inward of said distal front edge of said corresponding liner inner side walls and extending forward to a position substantially aligned with said breaker strip front walls; each mullion also including a front wall projecting substantially in the plane of said breaker strip front walls toward the front wall of said other mullion; and an elongated junction member joining adjacent portions of said mullion front walls so that the front of said cabinet consists of said breaker strip and mullion front walls.

39. A refrigerator cabinet as set forth in claim 38 wherein: one of said liners defines a fresh food storage compartment and the distance between the inner edge of said outer case stiffening flange adjacent said top and outer side walls of said one liner and said side walls of said corresponding breaker strip is between about 0.2 inch and about 0.4 inch.

40. A refrigerator cabinet as set forth in claim 38, wherein: one of said liners defines a freezer storage compartment and the distance between the inner edge of said outer case stiffening flange adjacent said top and outer side walls of said one liner and said side walls of said corresponding breaker strip is between about 0.5 inch and about 0.8 inch.

41. A refrigerator cabinet as set forth in claim 38, wherein: said stiffening flange extends inward from said outer case top and side walls a distance between about 1 inch and about 1.4 inches.

42. A refrigerator cabinet as set forth in claim 38, wherein: said stiffening flange has a thickness between about 0.06 inch and about 0.2 inch.

43. A refrigerator as set forth in claim 38, wherein:

a L-shaped reinforcing member is connected to each of said outer case side walls and corresponding portions of said stiffening flange; and each reinforcing member and said corresponding stiffening flange have a combined thickness between about 0.06 inch and about 0.2 inch.

44. A refrigerator cabinet as set forth in claim 38, wherein each of said breaker strip side walls extends rearward from said corresponding breaker strip front wall a distance of at least about 1.0 inch.

45. A refrigerator cabinet as set forth in claim 38, wherein: the distance from one mullion side wall to the other mullion side wall is between about 1.5 and about 2.0 inches wide.

46. A refrigerator as set forth in claim 39, wherein: said mullion side walls extend rearward from said mullion front walls a distance of at least about 1.0 inch.

47. A refrigerator cabinet as set forth in claim 38, further including:

a pair of doors having closed positions covering the front of corresponding liners; each of said doors including a peripheral flange positioned to be in register with said breaker strip front wall and the portion of said mullion front wall surrounding said corresponding liner when that door is in its closed position; and a gasket mounted to each of said door flanges and constructed to engage and essentially completely cover the corresponding front walls.

* * * * *